US005826305A

United States Patent [19]

Domenig et al.

[11] Patent Number: 5,826,305

[45] Date of Patent: Oct. 27, 1998

[54] FURNITURE HINGE

[75] Inventors: Georg Domenig; Andreas Moser, both of Kernersville, N.C.

[73] Assignee: Grass America, Inc., Kernersville, N.C.

[21] Appl. No.: 877,545

[22] Filed: Jun. 17, 1997

[51] Int. Cl.[6] ..... E05D 7/04

[52] U.S. Cl. ..... 16/235; 16/237

[58] Field of Search ..... 16/235, 236, 237–240, 16/254, 260, 261, 270–272, 389

[56] References Cited

U.S. PATENT DOCUMENTS

| | | | |
|---|---|---|---|
| 3,626,548 | 12/1971 | Grunert | 16/297 |
| 3,748,689 | 7/1973 | Grunert | 16/297 |
| 4,716,622 | 1/1988 | DeBruyn | 16/297 |
| 5,283,929 | 2/1994 | Lin | 16/237 |
| 5,295,282 | 3/1994 | Lautenschlager | 16/237 |
| 5,392,493 | 2/1995 | Youngdale | 16/237 |
| 5,511,287 | 4/1996 | Lautenschlager et al. | 16/239 |

*Primary Examiner*—Chuck Y. Mah

*Attorney, Agent, or Firm*—John M. Harrington; Kilpatrick Stockton LLP

[57] ABSTRACT

A hinge for mounting a door on a frame of a furniture articles includes a first hinge member such as a hinge cup to be mounted to the door, a hinge arm connected at one end of the hinge arm to the hinge cup on a pivot pin fixed in the hinge cup, and a second hinge member in the form of a hinge plate disposed on the other end of the hinge arm. The hinge plate includes an elongate opening with a centrally disposed first section and adjacent sections communicating with the first section through first and second gap formed by projections extending from opposing sides of the elongate opening towards one another. A fastening screw can be premounted in the hinge arm plate by insertion into the first section of the elongate opening. The fastening screw is provided with a threaded section which engages the projection. The threaded section of the fastening screw and an unthreaded section are configured to prevent passage of the fastening screw out of the first section of the elongate opening but to enable passage of the fastening screw for adjustment of the hinge arm plate on the frame member with a slight loosening of the fastening screw.

7 Claims, 2 Drawing Sheets

FURNITURE HINGE

BACKGROUND OF THE INVENTION

1. Field of the Invention

The present invention relates to a hinge for mounting a door on a frame of a furniture article and more particularly to a hinge with an adjustable hinge arm which enables adjustment of the mounted door relative to the supporting frame.

2. Description of the Prior Art

Various types of hinges for mounting a door on a furniture article such as a desk or cabinet have been used in the furniture and cabinetry industry for many years. One such device is known from U.S. Pat. No. 4,716,622. Many of such devices include multiple adjustment components making them bulky, difficult to adjust, quick to wear, and unstable. To provide adjustable hinges that are operable with greater efficiency and more precise reliability, it has been determined that more refined design engineering skills are required, and the present invention addresses this need and interest.

SUMMARY OF THE INVENTION

The general purpose of the present invention, which will be described subsequently in greater detail, is to provide a new and improved hinge for mounting a door on a frame of a furniture article such as a cabinet or desk and with an adjustable hinge arm for adjusting the door relative to the supporting frame that has all of the advantages of prior art hinges and none of the disadvantages. In order to attain this purpose, a representative embodiment of the present invention is illustrated in the drawings. The hinge of the present invention makes use of a first hinge member in the form of a cup mountable flush in a bore hole with fastening screws in a known way in the back of a door and a second hinge member adapted to be affixed to a frame. The second hinge member includes a substantially flat portion with an opening in the form of a closed end slot through which a fastening screw can be driven into the frame, likewise in a known way.

The hinge makes use of a first hinge arm segment having a rearward end portion pivoted to the first hinge member on a pivot axis such as a hinge pin fastened in the first hinge member. The first hinge arm segment also has a forward end portion on which is formed a first adjustment plate. Accordingly, the first hinge arm segment, with its rearward and forward end portions and first adjustment plate, is formed as one piece. The hinge also makes use of a second hinge arm segment with a rearward end portion which extends from the second hinge member and a forward end portion on which is formed a second adjustment plate. The second hinge arm member and the second hinge arm segment, with its rearward and forward end portions and second adjustment plate, are formed together as one piece.

The first and second hinge arm segments are connected to one another by screw means, such as a headed screw, cooperating with the first and second adjustment plates. When so connected to one another, the first and second hinge arm segments form a complete hinge arm with the rearward end portion of the first hinge arm segment pivoted to the first hinge member and the rearward end portion of the second hinge arm segment extending from and formed as one piece with the second hinge member.

Each of the first and second adjustment plates has a generally planar rectangular shape with opposing parallel lateral edges, which are spaced from one another by a distance which defines a respective width of the first and second adjustment plates. One of the first and second adjustment plates, and preferably the second adjustment plate, includes positioning means for aligning the first and second adjustment plates on one another in the form of a pair of opposing parallel flanges depending from the opposing lateral edges of the second adjustment plate to define a channel for receiving the first adjustment plate.

Accordingly, the opposing flanges of the second adjustment plate are spaced from one another by a distance which is at least as great as, or preferably slightly greater than the width of the first adjustment plate. The first adjustment plate is received in the channel formed between the opposing flanges of the second adjustment plate with the first and second adjustment plates generally parallel to one another and with the opposing lateral edges of the first adjustment plate adjacent the opposing flanges of the second adjustment plate. When so received, the first and second adjustment plates are aligned with one another and remain aligned with one another so long as the first and second hinge arm segments remain connected to one another.

One of the first and second adjustment plates, and preferably the second adjustment plate, also includes adjustment means cooperating with the screw of the screw means enabling limited adjustment of the first and second adjustment plates in relation to one another in the form of an open-ended elongate slot formed in the second adjustment plate, through which the screw of the screw means extends and which cooperates with the screw to permit movement of the first and second adjustment plates in relation to one another. The first adjustment plate includes portions defining a threaded opening which extends through the first adjustment plate and in which the threaded shaft portion of the screw is received.

A pair of projections disposed on the second adjustment plate proximate the open end of the open-ended slot cooperates with the head of the screw of the screw means to limit movement of the second adjustment plate in relation to the first adjustment plate. The open-ended slot of the second adjustment plate has a width that is at least as great as the diameter of the threaded shaft portion of the screw but less than the diameter of the head of the screw, and the projections are spaced from one another by a distance that is at least as great as the diameter of the threaded shaft portion of the screw but less than the diameter of the head of the screw.

In connecting the first and second hinge arm segments to one another, initially the threaded shaft portion of the screw is inserted and partly screwed into the threaded opening of the first adjustment plate with the head of the screw extending a distance above the top surface of the first adjustment plate. Then, the first adjustment plate is inserted into the channel formed between the opposing flanges of the second adjustment plate with the first and second adjustment plates substantially parallel to one another. The screw is only partly screwed into the threaded opening of the first adjustment plate with the head of the screw extending a sufficient distance above the top surface of the first adjustment plate to enable the projections proximate the open ended slot to pass underneath the head of the screw so that the threaded shaft portion of the screw passes into the open ended slot of the second adjustment plate with the top surface of the first adjustment plate confronting the bottom surface of the second adjustment plate. Thereafter, the screw can be tightened in the threaded opening of the first adjustment plate with the head of the screw against the top surface of the second adjustment plate urging the bottom surface of the second adjustment plate against the top surface of the first adjustment plate.

In order to adjust the first and second adjustment plates in relation to one another, the screw can be unscrewed slightly and loosened to allow movement of the first and second adjustment plates in relation to one other, and the after such movement is accomplished, the screw can be retightened. The purpose of such adjustment is to either lengthen or shorten the complete hinge arm formed by the first and second hinge arm segments, resulting in repositioning of the door relative to the frame, for example, to adjust the alignment of the door. To provide limitation of movement and to prevent disconnection of the first and second adjustment plates during adjustment, the screw is loosened only slightly so that the threaded shaft portion of the screw is free to move relative to the open-ended slot in a direction perpendicular to the pivot axis, but the projections prevent passage of the head of the screw and thus prevent dislodgement of the screw from the open ended slot. Further, when the screw is loosened slightly to enable such adjustment, pivoting or swivelling of the first and second adjustment plates in relation to one another is prevented by the relationship between the opposing parallel lateral edges of the first adjustment plate resting against the opposing parallel flanges of the second adjustment plate. The opposing lateral edges and opposing flanges are parallel to one another and perpendicular to the pivot axis, so movement of the first and second adjustment plates in relation to one another is limited to a direction parallel to one another and perpendicular to the pivot axis.

Preferably, the top surface of the first adjustment plate and the bottom surface of the second adjustment plate can be provided with complementary or corresponding serrations, which engage or interlock one another when the screw is tightened, in order to further secure the connection between the first and second adjustment plates. The serrations extend between the opposing lateral edges of the first adjustment plate and between the opposing lateral edges of the second adjustment plate, and when the screw is tightened, urging the top surface of the first adjustment plate against the bottom surface of the second adjustment plate, the respective serrations engage or interlock to prevent any movement of the first and second adjustment plates in relation to one another.

The foregoing focuses on the more important features of the invention in order that the detailed description which follows may be better understood and in order that the present contribution to the art may be better appreciated. There are, of course, additional features of the invention which will be described hereinafter and which will form the subject matter of the claims appended hereto. It is to be understood that the invention is not limited in its application to the details of construction and to the arrangement of the components set forth in the following description and drawings. The invention is capable of other embodiments and of being practiced and of being carried out in various ways.

It is to be further understood that the phraseology and terminology employed herein are for the purpose of description and are not to be regarded as limiting. Those skilled in the art will appreciate that the conception on which this disclosure is based may readily be used as a basis for designing the structures, methods and systems for carrying out the several purposes of the present invention. The claims are regarded as including such equivalent constructions so long as they do not depart from the spirit and scope of the present invention.

From the foregoing summary, it is apparent that an object of the present invention is to provide a new and improved hinge for mounting a door on a frame of a furniture article such as a desk or cabinet which has all of the advantages, and more, of prior art devices and none of the disadvantages.

It is another object of the present invention to provide a new and improved hinge for mounting a door on a frame of a furniture article that is more reliable and functional than those presently available.

Yet another object of the present invention is to provide a new and sophisticated, precision made adjustable hinge that is compact, can operate reliably and efficiently, and yet enable renewed, preselected limited adjustments to be made to the mounted door with respect to the frame of the furniture article.

These, together with other objects of the present invention, along with the various features of novelty which characterize the invention, are pointed out with particularity in the claims annexed to and forming a part of this document.

For a better understanding of the invention, its operating advantages, and the specific objects attained by its uses, reference should be made to the accompanying drawings in which like characters of reference designate like parts throughout the several views.

BRIEF DESCRIPTION OF THE DRAWINGS

This invention will be better understood and objects other than those set forth above, will become apparent when consideration is given to the following detailed description. Such description makes reference to the annexed drawings wherein.

DESCRIPTION OF THE PREFERRED EMBODIMENT

Figure 1:
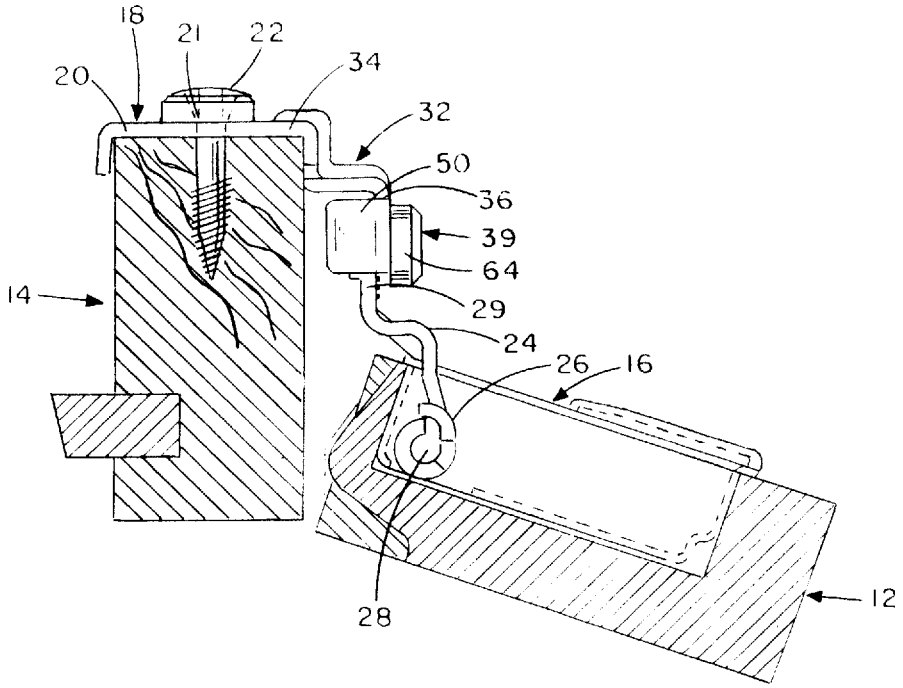
FIG. 1 is a partial section view of a hinge of the present invention mounted on a door and supporting frame member with the hinge in the open position.
Figure 2:
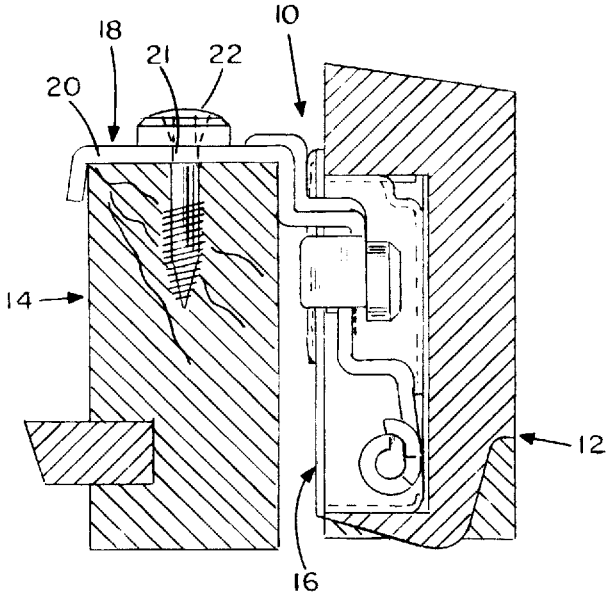
FIG. 2 is a partial section view of the hinge of FIG. 1 mounted on a door and supporting frame member with the hinge in the closed position.

Referring now to the drawings, and particularly to FIG. 1, the hinge of the present invention, shown generally as 10 in FIG. 1, serves to hang a door 12 on a frame 14 of furniture article, such as a cabinet. Frame 14 defines a door opening (not shown) on which door 12 is closed in the position of hinge 10 shown in FIG. 2 and open in the position of hinge 10 shown in FIG. 1. Hinge 10 includes a first hinge member 16 in the form of a cup mountable flush in a bore hole with fastening screws 17 in a known way in the back of door 12, as shown in FIGS. 1 and 2, and a second hinge member 18 adapted to be affixed to frame 14. Second hinge member 18 includes a substantially flat portion 20 with an opening in the form of a closed end slot through which a fastening screw 22 can be driven into frame 14, likewise in a known way.

Figure 3:
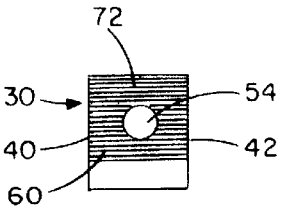
FIG. 3 is a top view of the first adjustment plate of the hinge of FIG. 1.
Figure 4:
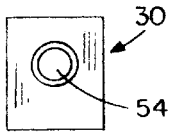
FIG. 4 is a bottom view of the first adjustment plate of the hinge of FIG. 1.
Figure 6:
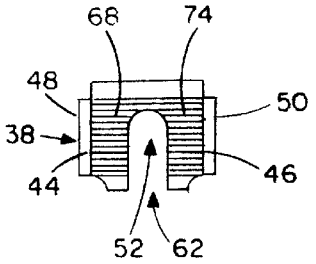
FIG. 6 is a bottom view of the second adjustment plate of the hinge of FIG. 1.
Figure 7:
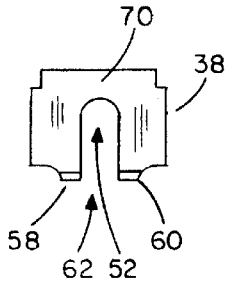
FIG. 7 is a top view of the second adjustment plate of the hinge of FIG. 1.
Figure 5:
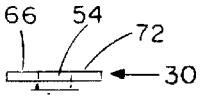
FIG. 5 is a side view of the first adjustment plate of the hinge of FIG. 1.
Figure 8:
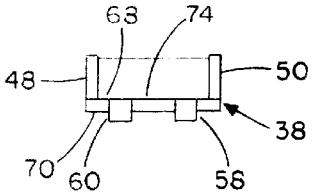
FIG. 8 is an end view of the second adjustment plate of the hinge of FIG. 1.

Hinge 10 makes use of a first hinge arm segment 24 having a rearward end portion 26 pivoted to first hinge member 16 on a pivot axis such as a hinge pin 28 fastened in first hinge member 16. First hinge arm segment 24 also has a forward end portion 29 on which is formed a first adjustment plate 30 as shown in FIGS. 3–5. In other words, first hinge arm segment 24, with its rearward and forward end portions 26, 29 and first adjustment plate 30, is formed as one piece. Hinge 10 also makes use of a second hinge arm segment 32 with a rearward end portion 34 which extends from second hinge member 18 and a forward end portion 36 on which is formed a second adjustment plate 38 as shown in FIGS. 6–8. Second hinge arm member 18 and second hinge arm segment 32, with its rearward and forward end portions 34, 36 and second adjustment plate 38, are formed together as one piece.

Figure 9:
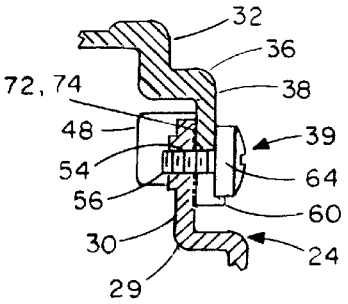
FIG. 9 is a fragmentary cross section of the first and second adjustment plates of the hinge of FIG. 1 connected to one another.

First and second hinge arm segments 24, 32 are connected to one another by screw means, such as headed screw 39, as shown in FIGS. 1 and 9, cooperating with first and second adjustment plates 30, 38. When so connected to one another, first and second hinge arm segments 24, 32 form a complete hinge arm with rearward end portion 26 of first hinge arm segment 24 pivoted to first hinge member 16 and rearward end portion 34 of second hinge arm segment 32 extending from and formed as one piece with second hinge member 18.

Each of first and second adjustment plates 30, 38 has a generally planar rectangular shape with opposing parallel lateral edges 40, 42 and 44, 46, respectively, which opposing edges 40, 42 and 44, 46 are each spaced from one another by a distance which defines a respective width of first and second adjustment plates 30, 38. One of the first and second adjustment plates 30, 38, and preferably second adjustment plate 38, includes positioning means for aligning first and second adjustment plates 30, 38 on one another in the form of a pair of opposing parallel flanges 48, 50 depending from opposing lateral edges 44, 46 of second adjustment plate 38 to define a channel for receiving first adjustment plate 30.

Accordingly, opposing flanges 48, 50 of second adjustment plate 38 are spaced from one another by a distance which is at least as great as, or preferably slightly greater than, the width of first adjustment plate 30. First adjustment plate 30 is received in the channel formed between opposing flanges 48, 50 of second adjustment plate 38 with the first and second adjustment plates 30, 38 generally parallel to one another and with opposing lateral edges 40, 42 of first adjustment plate 30 adjacent opposing flanges 48, 50 respectively of second adjustment plate 38. When so received, first and second adjustment plates 30, 38 are aligned with one another and remain aligned with one another so long as first and second hinge arm segments 24, 32 remain connected to one another.

Figure 10:
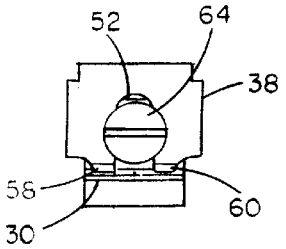
FIG. 10 is a top view of the first and second adjustment plates of the hinge of FIG. 1.
Figure 11:
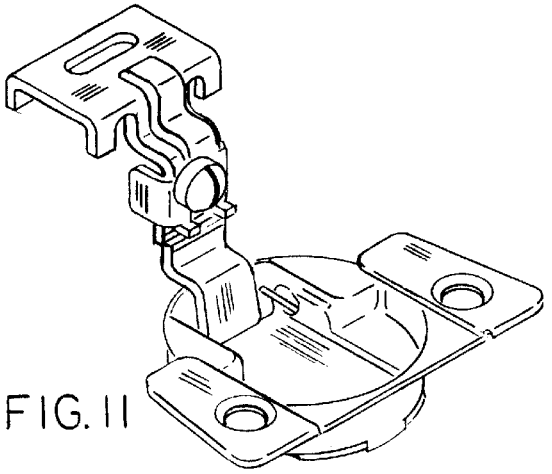
FIG. 11 is a perspective view of the hinge of FIG. 1.

One of first and second adjustment plates 30, 38, and preferably second adjustment plate 38, also includes adjustment means cooperating with screw 39 of the screw means enabling limited adjustment of first and second adjustment plates 30, 38 in relation to one another in the form of an open ended elongate slot 52 formed in second adjustment plate 38, as shown in FIGS. 6, 7, and 10, through which screw 39 extends and which cooperates with screw 39 to permit movement of first and second adjustment plates 30, 38 in relation to one another. First adjustment plate 30 includes portions defining a threaded opening 54 which extends through first adjustment plate 30 and in which threaded shaft portion 56 of screw 39 is received.

A pair of projections 58, 60 disposed on second adjustment plate 38 proximate open end 62 of open ended slot 52 cooperate with head 64 of screw 39 of the screw means to limit movement of second adjustment plate 38 in relation to first adjustment plate 30. Open ended slot 52 of second adjustment plate 38 has a width that is at least as great as the diameter of threaded shaft portion 56 but less than the diameter of head 64 of screw 39, and projections 58, 60 are spaced from one another by a distance that is at least as great as the diameter of threaded shaft portion 56 but less than the diameter of head 64 of screw 39.

In connecting first and second hinge arm segments 24, 32 to one another, initially threaded shaft portion 56 of screw 39 is inserted and partly screwed into threaded opening 54 of first adjustment plate 30 with head 64 extending a distance above top surface 66 of first adjustment plate 30. Then, first adjustment plate 30 is inserted into the channel formed between opposing flanges 48, 50 of second adjustment plate 38 with first and second adjustment plates 30, 38 substantially parallel to one another. Screw 39 is only partly screwed into threaded opening 54 of first adjustment plate 30 with head 64 extending a sufficient distance above top surface 66 of first adjustment plate 30 to enable projections 58, 60 proximate open ended slot 52 to pass underneath head 64, so that threaded shaft portion 56 passes into open ended slot 52 of second adjustment plate 38 with top surface 66 of first adjustment plate 30 confronting bottom surface 68 of second adjustment plate 38. Thereafter, screw 39 can be tightened in threaded opening 54 of first adjustment plate 30 with head 64 screwed against top surface 70 of second adjustment plate 38 urging bottom surface 68 of second adjustment plate 38 against top surface 66 of first adjustment plate 30.

In order to adjust first and second adjustment plates 30, 38 in relation to one another, screw 39 can be unscrewed slightly and loosened to allow movement of first and second adjustment plates 30, 38 in relation to one another, and then after such movement is accomplished, screw 39 can be retightened. The purpose of such adjustment is to either lengthen or shorten the complete hinge arm formed by first and second hinge arm segments 24, 32, resulting in repositioning door 12 relative to frame 14, for example, to adjust the alignment of door 12. To provide limitation of such movement and to prevent disconnection of first and second adjustment plates 30, 38 during adjustment, screw 39 is loosened only slightly so that threaded shaft portion 56 of screw 58 is free to move relative to open ended slot 52 in a direction perpendicular to pivot axis 28, but projections 58, 60 prevent passage of head 64 and thus prevent dislodgement of screw 39 from open ended slot 52.

Further, when screw 39 is loosened slightly to enable such adjustment, pivoting or swiveling of first and second adjustment plates 30, 38, and consequently of first and second hinge arm segments 24, 32, in relation to one another is prevented by the relationship between opposing parallel lateral edges 40, 42 of first adjustment plate 30 resting against opposing parallel flanges 48, 50 of second adjustment plate 38. Opposing lateral edges 40, 42 and opposing flanges 48, 50 are parallel to each other and perpendicular to pivot axis 28, so movement of first and second adjustment plates 30, 38 in relation to one another is limited to a direction parallel to one another and perpendicular to pivot axis 28.

Preferably, top surface 66 of first adjustment plate 30 and bottom surface 68 of second adjustment plate 38 can be provided with complementary or corresponding serrations 72, 74, which engage or interlock when screw 39 is tightened, in order to further secure the connection between first and second adjustment plates 30, 38. Serrations 72 extend between opposing lateral edges 40, 42 of first adjustment plate 30 and serrations 74 extend between opposing lateral edges 44, 46 of second adjustment plate 38, and when screw 39 is tightened, urging top surface 66 of first adjustment plate 30 against bottom surface 68 of second adjustment plate 38, respective serrations 72, 74 engage or interlock to prevent any movement of first and second adjustment plates 30, 38 in relation to one another.

With respect to the descriptions set forth above, optimum dimensional relationship of parts of the invention (to include variations in size, materials, shape, form, function and manner of operation, assembly and use) are deemed readily apparent and obvious to those skilled in the art, and all equivalent relationships to those illustrated in the drawings and described in the specification are intended to be encompassed herein. The foregoing is considered as illustrative only of the principal of the invention. Since numerous modifications and changes will readily occur to those skilled in the art, it is not intended to limit the invention to the exact construction and operation shown and described, and all suitable modifications and equivalents falling within the scope of the appended claims are deemed within the present inventive concept.

What is claimed is:

1. A hinge for mounting a door on a frame of a furniture article, comprising:

a first hinge member adapted to be affixed to the furniture door;

a first hinge arm segment having a rearward end portion pivoted to the first hinge member on a pivot axis and having a forward end portion on which is formed a first adjustment plate, the rearward and forward end portions and the first adjustment plate of the forward end portion of the first hinge arm segment being formed as one piece;

a second hinge member adapted to be fastened to the furniture article frame;

a second hinge arm segment having a rearward end portion extending from the second hinge member, the second hinge member and second hinge arm segment being formed as one piece, and the second hinge arm segment having a forward end portion on which is formed a second adjustment plate;

the first and second hinge arm segments being connected to one another by screw means cooperating with the respective adjustment plates, one of the first and second adjustment plates, including positioning, means aligning the first and second adjustment plates on one another, and one of the first and second adjustment plates, including adjustment, means cooperating with the screw means to enable limited adjustment of the first and second adjustment plates in relation to one another;

said adjustment means comprising an open ended elongated slot formed in the second adjustment plate through which the screw means extends and which cooperates with the screw means to permit movement of the first and second adjustment plates in relation to one another; and said first adjustment plate having portions defining a threaded opening, and wherein said screw means comprises a headed screw with a threaded shaft portion which is received in said threaded opening.

2. A hinge, according to claim 1, each of said first and second adjustment plates having opposing lateral edges, and wherein said positioning means comprises a pair of opposing flanges depending from the opposing lateral edges of the second adjustment plate to define a channel for receiving the first adjustment plate.

3. A hinge, according to claim 2, said opposing lateral edges of the first and second adjustment plates being spaced from one another a distance which defines a width of the respective adjustment plates, and said opposing flanges being spaced from one another a distance which is at least as great as the width of the first adjustment plate.

4. A hinge, according to claim 3, said adjustment means further comprising a pair of projections disposed proximate the open end of said open ended slot which cooperates with said headed screw to limit movement of the first and second adjustment plates in relation to one another.

5. A hinge, according to claim 4, wherein each of said first and second adjustment plates has a top and a bottom surface, with serrations formed on the top surface of said first adjustment plate and corresponding serrations on the bottom surface of the second adjustment plate, which serrate surfaces cooperate with one another.

6. A hinge, according to claim 5, wherein said open ended slot of the second adjustment plate has a width that is at least as great as a diameter of the threaded shaft portion of the screw, and wherein said pair of projections are spaced from one another by a distance that is less than a diameter of the screw head.

7. A hinge, according to claim 6, wherein said projections are dimensioned to permit said screw head to pass over the projections upon loosening said threaded shaft portion of the screw in said threaded opening.

* * * * *